US005212965A

United States Patent [19]

Datta

[11] Patent Number: 5,212,965

[45] Date of Patent: May 25, 1993

[54] EVAPORATOR WITH INTEGRAL LIQUID SUB-COOLING AND REFRIGERATION SYSTEM THEREFOR

[76] Inventor: Chander Datta, R.R. #6, Kingston, Ontario K7L 4V3, Canada

[21] Appl. No.: 763,578

[22] Filed: Sep. 23, 1991

[51] Int. Cl.[5] ..... F25B 39/02

[52] U.S. Cl. ..... 62/515; 62/513

[58] Field of Search ..... 62/515, 113, 513

[56] References Cited

U.S. PATENT DOCUMENTS 4,683,726 8/1987 Barron ..... 62/513
4,702,086 10/1987 Nunn, Sr. et al. ..... 62/513
4,811,568 3/1989 Horan et al. ..... 62/513

FOREIGN PATENT DOCUMENTS 1312802 12/1962 France .

*Primary Examiner*—Ronald Capossela

*Attorney, Agent, or Firm*—Daniel E. Kramer

[57] ABSTRACT

An improved refrigeration evaporator having a first heat exchange element including a fluid inlet and a fluid outlet, for cooling a fluid stream traversing the evaporator by evaporating a volatile refrigerant liquid in heat exchange relation to the fluid stream. The volatile refrigerant liquid is supplied to the evaporator at relatively high saturated condensing temperature and slightly subcooled. The improvement in the refrigeration evaporator comprises a second heat exchange element, positioned in the fluid stream entering the first heat exchange element. The second heat exchange element cools and thereby further subcools the volatile refrigerant liquid prior to the refrigerant liquid entering the first heat exchange element via a pressure reducing device. The fluid stream being cooled may be either gas or liquid and the evaporator may be of the type best adapted for the type of fluid being cooled.

23 Claims, 4 Drawing Sheets

EVAPORATOR WITH INTEGRAL LIQUID SUB-COOLING AND REFRIGERATION SYSTEM THEREFOR

FIELD OF THE INVENTION

The present invention relates primarily to compression type refrigeration systems which utilize an evaporator to cool a fluid stream.

The invention further relates to refrigeration systems having condensing means for delivering refrigerant liquid at a relatively high saturated temperature and slight subcooling, to an expansion device feeding such an evaporator.

The invention further relates to refrigeration evaporators which have two heat exchange elements; a first element for cooling the fluid stream through heat exchange with evaporating refrigerant, and a second element positioned in the fluid stream entering the first element for cooling and further subcooling the refrigerant liquid which is then directed through an expansion device and the second element seriatim.

BACKGROUND OF THE INVENTION

Compression type refrigeration systems employ an evaporator which is supplied with low pressure refrigerant liquid. The low pressure refrigerant boils away or evaporates when supplied with heat from a medium to be cooled. The most common media which are cooled by such systems are streams of air, and streams of water or aqueous brines. The refrigerant vapor emitted from the evaporator is delivered by a pipe called a suction line to a mechanism which simultaneously acts as a vacuum pump to draw vapor from the evaporator and as a condensing device to restore the refrigerant vapor to a liquid condition so it can be reused in the evaporating part of the refrigerating cycle. The evacuating and condensing mechanism is called a condensing unit. The condensing unit has two major components. The evacuating device is most frequently a mechanical compressor driven by an electric motor. The compressor draws refrigerant vapor from the evaporator and compresses it and delivers it via a pipe to a condenser. The condenser condenses the hot refrigerant vapor to a refrigerant liquid by bringing it into heat exchange with a coolant. The most commonly employed coolants are air, employed in air-cooled condensers, water, employed in water cooled condensers and a mixture of air and water employed in so-called evaporative condensers.

The refrigerant liquid is then generally transmitted from the condenser to a holding tank called a receiver, where it is stored until needed by the evaporator. The refrigerant liquid when stored in the receiver generally has a temperature which is a few degrees cooler than the temperature at which it condensed called the saturated condensing temperature. The number of degrees which the refrigerant liquid is cooler than the saturated condensing temperature is called the subcooling or the degrees of subcooling. When the refrigerant liquid leaves the receiver it is in the form of liquid without any bubbles. However, if the subcooling is reduced to zero either by warming the refrigerant liquid those few degrees of subcooling or by lowering the pressure on the refrigerant liquid, bubbles, often called flash-gas, will form in the refrigerant liquid.

When the refrigerant liquid flows toward the evaporator from the receiver in a pipe called the liquid line, it is at high pressure. In order for the refrigerant liquid to evaporate and cool the fluid needing refrigeration, its pressure must be reduced. This pressure reduction is secured by passing the high pressure refrigerant liquid through a flow restrictor, also called an expansion device. Flow restrictors come in many forms. One is in the form of a length of tubing having a very small bore called a capillary tube. It is the form of restrictor most often used in domestic refrigerators, freezers and room air-conditioners. Another is in the form of a fixed orifice, frequently used in automotive air-conditioners. The form of restrictor most frequently employed in larger commercial or industrial refrigeration systems of the type toward which the present invention is primarily directed is a valve which senses both the pressure in the evaporator and the temperature at the refrigerant vapor outlet of the evaporator. This dual sensing valve is called a thermal expansion valve or TEV or TXV for short.

TEV's work best when the refrigerant liquid fed to them is free of bubbles. Such bubble-free liquid is also called clear liquid or "solid" liquid. Used in this sense, "solid" liquid is not frozen liquid but is simply refrigerant liquid which is free of bubbles.

Since the refrigerant liquid which is stored in the liquid receiver has only a few degrees of subcooling, it is not uncommon for the refrigerant liquid to reach the TEV inlet in a bubbling state. Expansion valves receiving bubbling refrigerant liquid tend to act erratically. Erratic TEV performance has a detrimental effect on evaporator capacity and therefore on overall system capacity.

To overcome the tendency of refrigeration systems to deliver bubbling refrigerant liquid to their TEV so-called suction-liquid heat exchangers are frequently employed. These heat exchangers are installed in the system suction line. The piping is arranged to pass the vapor emitted from the suction outlet of the evaporator in heat exchange relation to the high pressure refrigerant liquid flowing from the receiver to the TEV. This heat exchange cools the refrigerant liquid and either condenses bubbles if any have formed in the liquid, or increases the degree of subcooling of the refrigerant liquid, thereby reducing the propensity of the refrigerant liquid to form bubbles.

Unfortunately, suction-liquid heat exchangers have a series of disadvantages.

First, they introduce pressure drop in the suction line. Suction line pressure drop has the effect of reducing compressor capacity and therefore system capacity.

Second, they warm the suction vapor returning to the compressor from the evaporator with exactly the same number of heat units (Btus, calories etc) that are extracted from the refrigerant liquid flowing through the exchanger. The warmed suction vapor has dual negative effects: that of reducing the compressor capacity by presenting to the compressor warmed and therefor less dense refrigerant vapor to compress; and that of causing the high pressure vapor discharged by the compressor to be hotter than necessary. The higher the compressor discharge temperature, the thinner the compressor lubricant and the more likely the lubricant will suffer some thermolytic degradation resulting in shortened compressor life.

Third, suction-liquid heat exchangers fail to work when most needed. For example, when the TEV is in the mode of receiving a mixture of liquid and vapor, its flow capacity is so reduced that the evaporator cannot be fully flooded. Therefore the refrigerant vapor leaving the evaporator is warm and relatively ineffective to substantially cool the liquid/vapor mixture flowing toward the TEV.

Fourth, the suction-liquid heat exchanger cannot reduce the temperature of the refrigerant liquid flowing to the TEV to near the temperature of the fluid entering the evaporator, though the greatest improvement in evaporator capacity and stability of TEV performance is achieved with coldest liquid entering the TEV.

Finally, the suction-liquid heat exchanger is costly both to manufacture and to install.

It is against this background that I have conceived the present invention which avoids all the problems described above.

My improved evaporator with integral liquid subcooling does not contribute to any suction line pressure drop.

My improved evaporator does not contribute to any warming of the suction vapor enroute from the evaporator to the compressor.

My improved evaporator works to subcool refrigerant liquid flowing to the TEV even when the evaporator is not fully flooded with refrigerant liquid.

My improved evaporator cools the refrigerant liquid flowing to the TEV to a temperature close to the temperature of the fluid entering the evaporator.

My improved evaporator, when fabricated as described, is essentially free of extra material and installation cost.

In addition, compared to a conventional evaporator, my improved evaporator has the following further advantages:

It guarantees 100% refrigerant liquid at the TEV inlet.

It increases both the evaporator and the system capacity.

In low and medium temperature refrigeration applications it reduces the amount of surface participating in frost accumulation, thereby reducing both the time and energy required for a complete defrost.

In medium temperature refrigeration systems, i.e. those operating with box temperatures in the range of 32° F. to 42° F. (0° C.-5.5° C.), it provides increased sensible heat ratio of the evaporator, thereby maintaining higher relative humidity in the storage area for less dehydration of fresh food stored within.

In airconditioning applications with high sensible heat loads, i.e. computer room applications, it provides increased sensible heat ratio of the evaporator.

In heat pump applications, it causes the evaporator to operate with higher air temperatures entering the evaporator, thus enhancing system coefficient of performance (COP).

It is adaptable to both finned coil evaporators for cooling air and to shell type evaporators for cooling liquid.

SUMMARY OF THE INVENTION

Briefly stated the present invention comprises an improved evaporator for cooling a fluid stream. The evaporator is adapted for use in a refrigeration system having evacuating means for withdrawing vapor from the evaporator and condensing means for converting the vapor to a high pressure liquid flowing to the evaporator.

The evaporator comprises first heat transfer means for receiving the high pressure refrigerant liquid from the condensing means and for exchanging heat between the high pressure refrigerant liquid and the fluid stream thereby cooling the high pressure refrigerant liquid and discharging it and warming the fluid stream and discharging it.

The evaporator includes pressure reducing means for receiving the cooled high pressure refrigerant liquid discharged by the first heat transfer means and for discharging the refrigerant at reduced pressure.

The evaporator further includes second heat transfer means for receiving the warmed fluid stream discharged by the first heat transfer means and for receiving the reduced pressure refrigerant liquid discharged by the pressure reducing means and exchanging heat between the warm fluid stream and the reduced pressure refrigerant liquid thereby cooling the fluid stream and evaporating the reduced pressure refrigerant liquid.

BRIEF DESCRIPTION OF THE DRAWINGS

The forgoing summary, as well as the following description of preferred embodiments of the present invention, will be better understood when read in connection with the appended drawings. For the purpose of illustrating the invention, there is shown in the drawings embodiments which are presently preferred. It must be understood, however, that the invention is not limited to the specific instrumentalities or the precise arrangements of the disclosed elements. In the drawings.

DETAILED DESCRIPTION OF THE INVENTION

Figure 1:
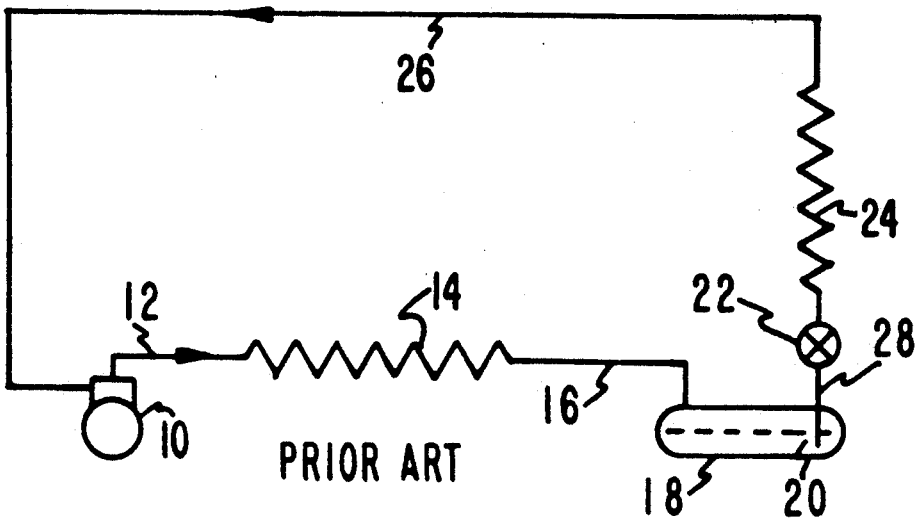
FIG. 1 is a schematic piping diagram of a conventional prior art refrigeration system.

Referring now to the drawings, wherein like references are employed to indicate like elements, there is shown in FIG. 1 a schematic piping diagram and major element representation of a conventional compression refrigeration system of the type which is common to most residential central airconditioning systems, and substantially all commercial and industrial refrigeration systems. Evaporator 24 is the cooling element. In systems employed to cool refrigerated storage rooms, one or more fans, not shown, are associated with evaporator 24 for the purpose of drawing warm air from the storage, circulating the air through evaporator 24, thereby cooling the air, and discharging the cooled air back into the storage room. Evaporator 24 is fed refrigerant liquid from the expansion device 22. The refrigerant liquid fed to the evaporator 24 is generally mixed with a quantity of flash gas which forms in the TEV during the pressure reduction process, even when the refrigerant liquid fed to the TEV is bubble-free.

The vapor leaving evaporator 24 flows back to evacuating device/compressor 10 through suction line 26. This vapor is the sum of the vapor arising from the liquid evaporated in the evaporator 24 and the flash gas arising in the TEV. Evacuating device/compressor 10 is simultaneously a compressor and an evacuating device, depending on whether the observer is looking at its function of drawing refrigerant vapor from the evaporator or compressing the refrigerant vapor. For the remainder of this detailed description, item 10 will be referred to as compressor 10.

The vapor having been withdrawn from evaporator 24 is compressed by compressor 10 and delivered through discharge line 12 to condenser 14, where a coolant such as ambient air or water removes the latent heat of condensation from the refrigerant vapor, thereby causing it to condense to a liquid. The refrigerant liquid flows from condenser 14 through pipe 16 to receiver 18 where it is stored until needed as refrigerant liquid pool 20. The refrigerant liquid is then delivered as needed from pool 20 to TEV 22 via liquid line 28, thereby repeating the cycle. The inlet end of liquid line 28 is immersed in the liquid pool 20.

The refrigerant liquid stored as pool 20 within receiver 18 normally has about 6° F. (3° C.) subcooling. If the refrigerant liquid flowing to TEV 22 is warmed that number of degrees or if its pressure is reduced, flashing of the refrigerant liquid occurs. Pressure reduction in the refrigerant liquid can be caused either by an increase in elevation of liquid line 28, as would be required if TEV 22 were located many feet over receiver 18, or by pressure drop in liquid line 28 or pressure drop in a flow element contained in liquid line 28 or both. Among pressure drop producing flow elements normally found in liquid lines, but not shown in the figures are driers, solenoid valves, hand valves, check valves and pressure regulating valves.

In order to control these flash gas producing factors many costly design stratagems are employed. Among these are increasing the diameter of the liquid line 28, raising the condenser and receiver to a level near that of the TEV, oversizing all the pressure-drop producing flow elements or providing a suction-liquid heat exchanger. In some cases, it is so difficult to maintain a bubble-free supply of refrigerant liquid to the TEV 22 that the TEV is deliberately oversized to allow a semblance of reasonable, though significantly degraded, performance with bubbles entering the TEV.

Figure 2:
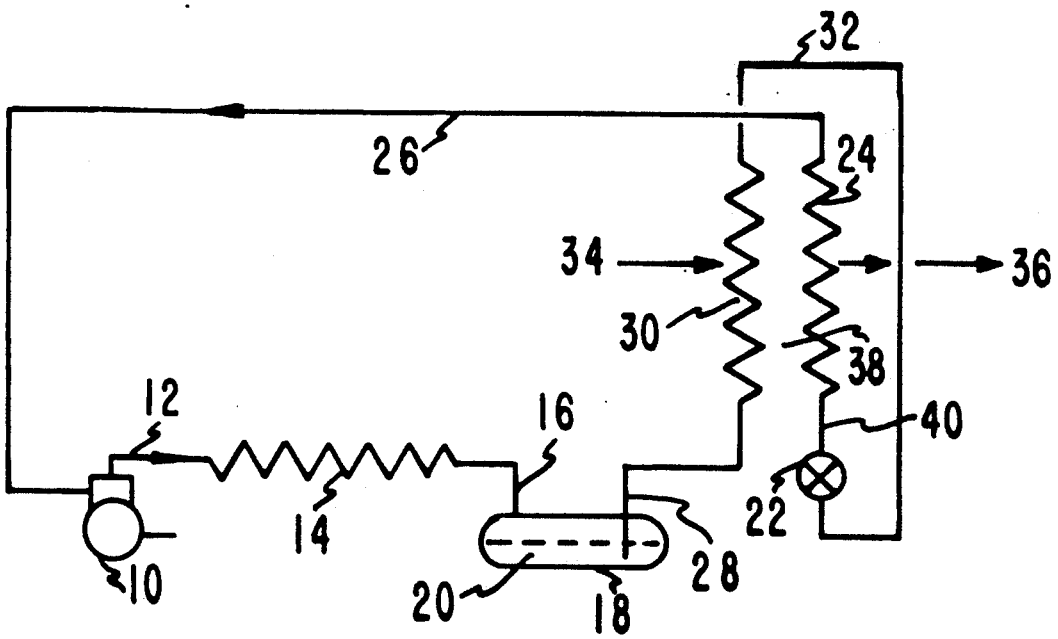
FIG. 2 is a schematic representation of a version of the present invention.

FIG. 2 shows a schematic piping diagram of a system containing an embodiment of the present invention. In the system of FIG. 2, TEV 22, evaporator 24, suction line 26, compressor 10, discharge line 12, condenser 14 and receiver 18 remain unchanged from the system of FIG. 1. In accord with the present invention, subcooling heat exchanger 30 has been positioned in the air stream 34 entering evaporator 24. Refrigerant liquid from the pool 20 residing in receiver 18 is conveyed by liquid line 28 to subcooling heat-exchanger 30. In one mode of operation the refrigerant liquid reaches the subcooling heat exchanger 30 in bubble-free condition but having only about 6° F. (3.3° C.) subcooling. The subcooling heat exchanger 30, through its heat exchange interaction with cold entering air stream 34, further cools the refrigerant liquid, thereby sharply increasing its subcooling and placing the refrigerant liquid in a perfect condition to be controlled by TEV 22. In a second mode of operation the refrigerant liquid reaches subcooling heat exchanger in bubbling condition, that is, having refrigerant vapor or flash gas mixed with the refrigerant liquid. In that mode of operation, subcooling heat exchanger 30 first acts to completely condense all the vapor or flash gas. When condensation of the flash gas is complete, the subcooling heat exchanger 30 proceeds to subcool the now bubble-free stream of refrigerant liquid, again providing a perfect liquid condition for control by TEV 22.

Figure 3:
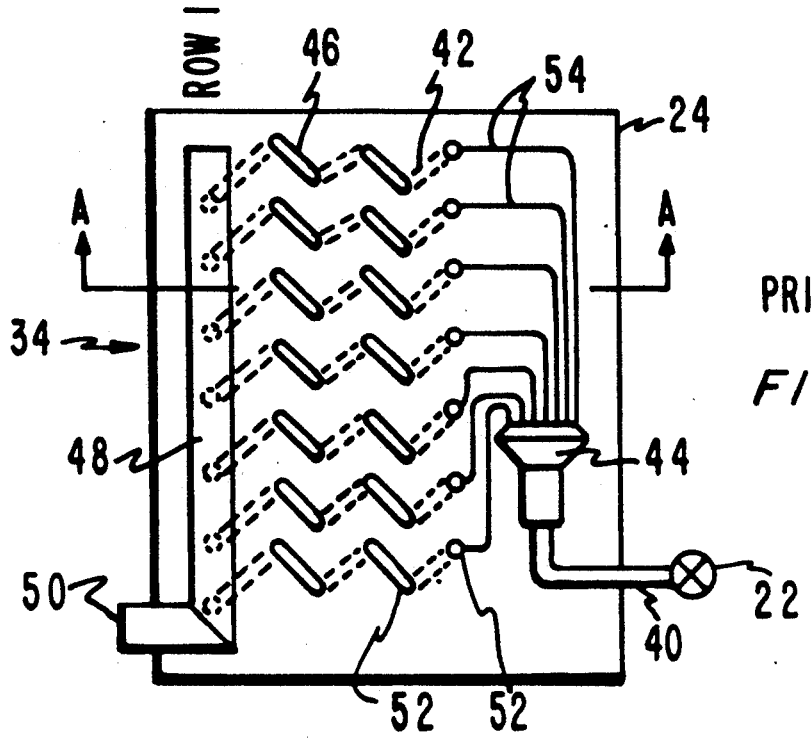
PRIOR ART FIG. 3
FIG. 3 is an end elevation of a multi-pass prior art refrigeration evaporator for cooling air.

Referring now to FIG. 3 there is shown an end elevational view of a fin/tube core having seven layers of six tubes 52 each. The core is circuited as a prior art refrigeration evaporator 24, having 7 layered refrigerant circuits, each circuit having six tubes 52. Each circuit is fed a substantially equal amount of refrigerant liquid from distributor 44 via small distributing tubes 54. The refrigerant liquid fed into the circuits abstracts heat from the airstream 34, thereby cooling it and simultaneously evaporating all the refrigerant liquid to vapor. The vapor from each of the 7 layered circuits is collected in manifold 48 which connects with suction line 26 of FIG. 1 by way of suction outlet connection 50. Row 1 is identified as the first vertical row of tubes affected by entering air stream 34.

Figure 4:
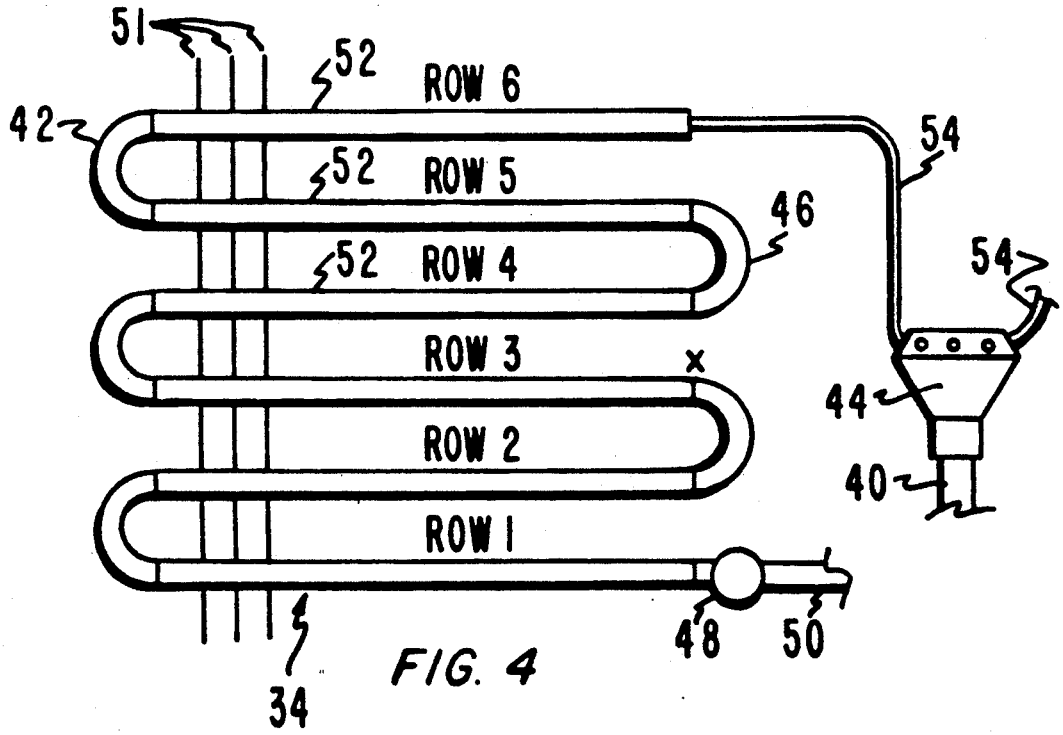
FIG. 4 is a sectional view of the evaporator of FIG. 3 taken at A—A identifying the tubing rows in the direction of airflow.

FIG. 4 shows a cross section of evaporator 24 of FIG. 3 taken at section A—A. Although only a few transverse fins 5; are shown, fins 51 are spaced uniformly over the full length of the tubes 52 of the evaporator. The rows are numbered in the direction of airflow 34. Note that each circuit is arranged with the evaporating refrigerant in counterflow with the airflow.

Figure 5:
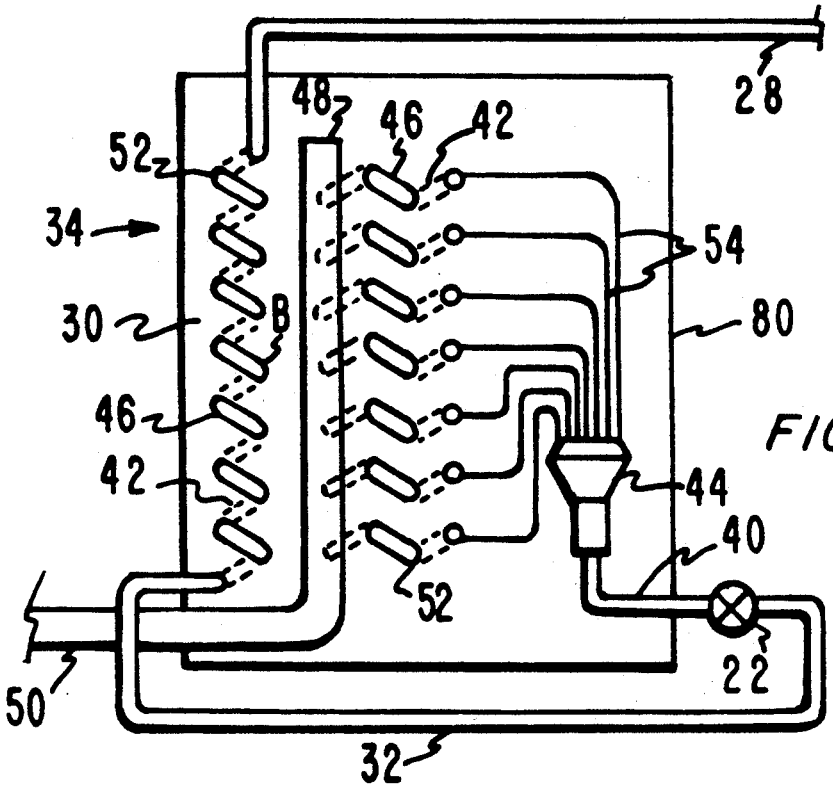
FIG. 5 shows a side elevation of the evaporator core of FIG. 3 recircuited to embody the elements of a preferred embodiment of the present invention.

FIG. 5 is an end elevational view of the same fin/tube core of FIG. 3 except circuited in accord with the present invention. The core is mounted within a casing 80 adapted for the flow of air stream 34. The suction manifold 48 is connected to the end of tubes 52 comprising row 3 so that coil rows number 3, 4, 5 and 6 are connected to the distributor 44 and suction manifold 48 for the evaporating function. The position of the suction manifold is marked by 'x' in the sectional view of a single circuit of FIG. 4.

In the embodiment shown in FIG. 5, the tubes 52 in rows 1 and 2 are joined into a single series subcooling circuit 30. Subcooling circuit 30 is connected at one end to liquid line 28 and at the other end to one end of conduit 32. The other end of conduit 32 is connected to the inlet of TEV 22. In other embodiments of the present invention, the tubes 52 in rows 1 and 2 which are the subcooling heat exchanger 30 are circuited in two circuits each circuit having seven tubes or in other combinations of circuits and number of tubes.

Calculations have shown that, despite the reduced surface available to the evaporating function generated by use of rows 1 and 2 for the construction of the subcooling heat exchanger 30, the capacity of the remaining portion of the evaporator 24 and the total capacity of the system employing the integrated subcooling-evaporator of FIG. 5, is greater than the capacity of the same system employing the prior art evaporator 24 of FIG. 3, having six rows of coil used for evaporation. The reasons for this completely unobvious and unexpected performance of the subcooling evaporator of the present invention, as shown in FIG. 5 and described above, are: first, that the TEV performs in a completely stable manner having a stream of totally bubble free, subcooled liquid fed to its inlet; second, that the evaporating heat exchanger 24 has a substantially higher capacity when its TEV 22 is fed a stream of highly subcooled refrigerant liquid. Cold and highly subcooled refrigerant liquid flowing through the TEV generates much less flash gas in the TEV than warm or hot refrigerant liquid flowing through the TEV. With much less flash gas formed initially in the TEV, there is a higher percentage of refrigerant liquid in the evaporator tubes, thereby providing better wetting of the inside of the tubes 52 by the refrigerant liquid, and therefore higher heat transfer coefficients, resulting in improved evaporator performance. Third, the subcooling heat exchanger 30, positioned in the entering airstream to the evaporator coil 24, warms the air entering evaporator 24. This warmer air serves to raise the temperature differential between the refrigerant liquid evaporating inside tubes 52 of the evaporator heat exchanger 24 and the air stream traversing it. With the evaporator 24 of the subcooling evaporator of FIG. 5 operating at a higher temperature differential than the prior art evaporator 24 of FIG. 3 its capacity is greater and therefore the system suction pressure is greater resulting in improved compressor and therefore system capacity.

In one mode of usage of the present invention as represented by FIGS. 2 and 5, the evaporator 24 and its associated subcooling heat exchanger 30 are located within a room designed for frozen food storage having a storage temperature of 0° F. (−18° C.). Entering airstream 34 is at 0° F. If no measures to avoid flashing of refrigerant 20 are taken, and the refrigerant liquid is subject to flashing conditions, the bubbling refrigerant liquid at one condition enters subcooling heat exchanger 30 at 115° F. (46° C.). Within the heat exchanger 30 all the flash gas is condensed and the refrigerant liquid is cooled to about 5° F. (−15°C.). The now bubble-free refrigerant liquid has a subcooling of about 110° F. (61° C.), more than enough to ensure flow to TEV 22 as a pure bubble-free liquid for effective control by the TEV 22 and to achieve the effects described above.

Figure 6:
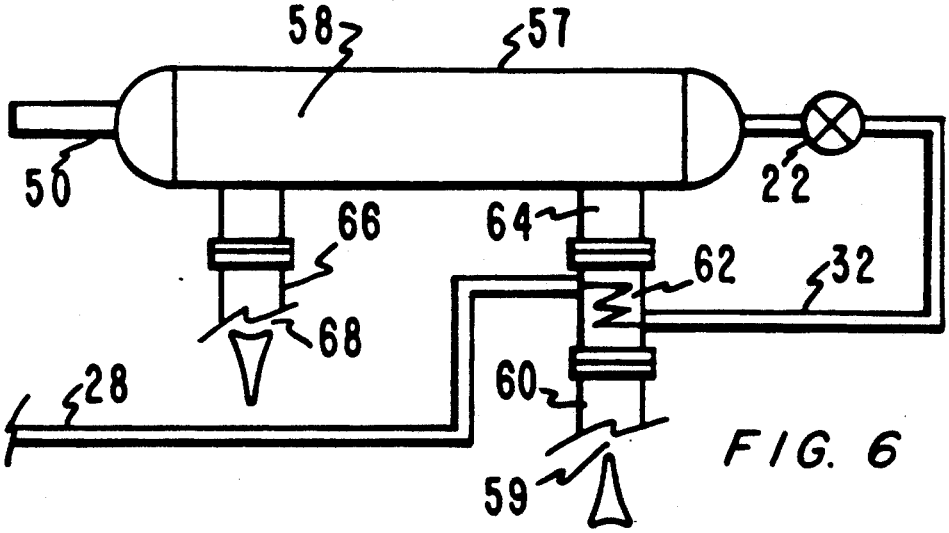
FIG. 6 displays a schematic piping diagram of a first embodiment of the present invention including a liquid chilling evaporator.

The above advantages are achieved as well when liquid cooling evaporators are employed. In FIG. 6 liquid cooling evaporator 58 has liquid inlet connection 64 and liquid outlet connection 66. The liquid-to-be-cooled 59, flowing through the heat exchanger 58 through its inlet and outlet connections 64 and 66, respectively, is typically water, though a wide variety of other liquids such as brines of various types and many organic chemicals are commonly cooled in such heat exchangers. Refrigerant liquid is fed into liquid cooling evaporator 58 under the control of TEV 22. Refrigerant vapor resulting from the evaporation of the refrigerant liquid in liquid cooling evaporator 58 is conveyed to suction line 26 of the system in FIG. 2 through evaporator outlet connection 50. Positioned in the pipe conveying the liquid to be cooled to the inlet connection 64 of the liquid cooling evaporator 58 is a subcooling heat exchange element 62. Refrigerant liquid, having slight subcooling, or no subcooling and containing a quantity of bubbles or flash gas, flows from the receiver 18 of FIG. 2 through liquid line 28 and is conveyed to subcooling heat exchanger element 62. There it is cooled and the flash gas and bubbles if any condensed to liquid. The then bubble free liquid stream is FIG. 2, and delivered to TEV 22 by way of subcooled liquid conduit 32.

Figure 7:
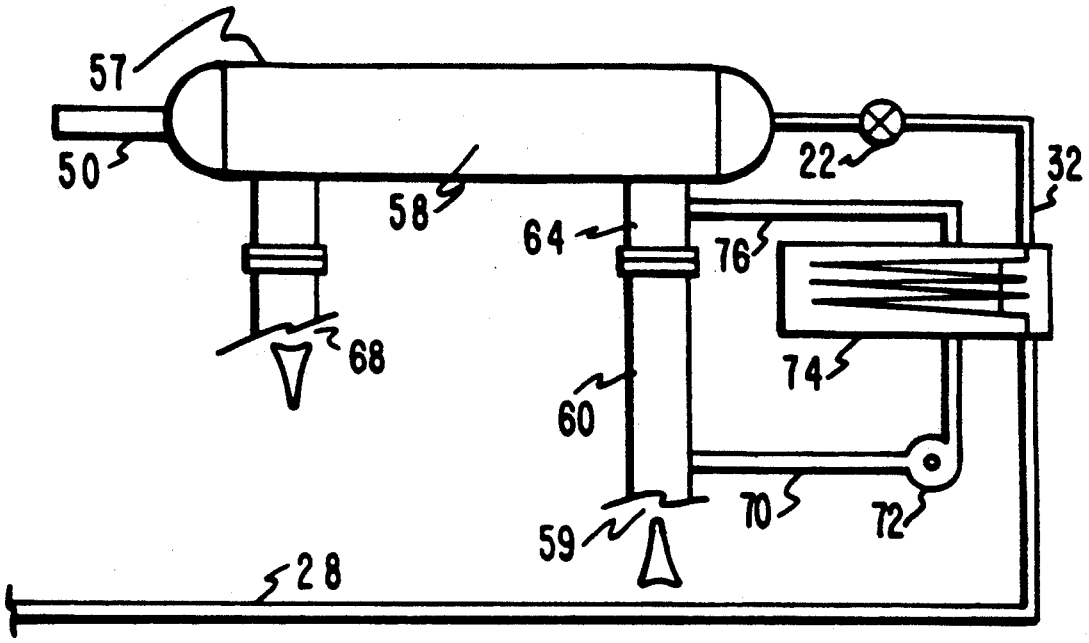
FIG. 7 shows a schematic piping diagram of a second embodiment of the present invention including a liquid chilling evaporator.

FIG. 7 is another embodiment of the present invention. In FIG. 7 the subcooling heat exchanger 74 is in a flow loop which includes pump 72 positioned to withdraw a fraction of the liquid from the full flow stream 59 entering the liquid chilling heat exchanger 58 via conduit 70 and circulate the liquid fraction through subcooling heat exchanger 74. The warmed liquid fraction is then returned, by way of conduit 76, to the main liquid flow stream entering heat exchanger 58. Slightly subcooled refrigerant liquid, or refrigerant liquid mixed with vapor which enters subcooling heat exchanger 74 via liquid line 28 is cooled and the vapor, consisting of flash gas or bubbles, is condensed. The then bubble free refrigerant liquid is subcooled, exactly as described in connection with the system of FIG. 2, and delivered to TEV 22 by way of subcooled refrigerant liquid conduit 32.

Figure 8:
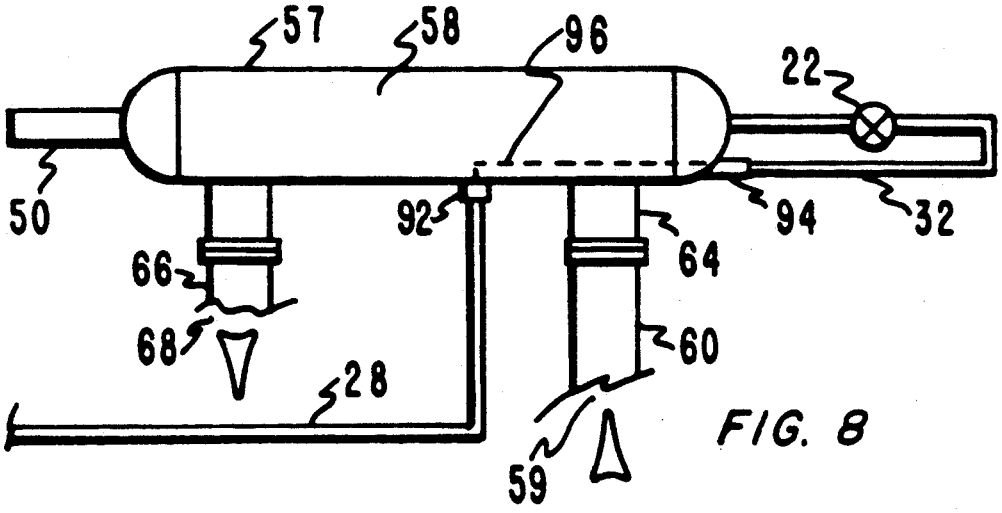
FIG. 8 is a schematic representation of a third embodiment of a liquid chilling evaporator embodying the present invention.

FIG. 8 is an embodiment of the present invention directed toward liquid cooling evaporator 58 having shell 57. Warm bubble laden liquid refrigerant is conveyed via conduit 28 toward TEV 22. Enroute the warm liquid within conduit 28 enters subcooling heat exchanger 96, positioned within shell 57 of liquid cooling heat exchanger 58, through its inlet fitting 92. The warm liquid refrigerant having been cooled by its passage through subcooling heat exchange element 96 exits the subcooling heat exchanger 96 and enters subcooled liquid refrigerant conduit 32 by way of exit fitting 94, flowing therethrough to TEV 22.

From the foregoing description, it can be seen that the present invention comprises an improved subcooling evaporator for use in air cooling refrigeration, in liquid cooling and in airconditioning systems. It will be appreciated by those skilled in the art that changes could be made to the above described embodiments without departing from the broad inventive concepts thereof. It is understood, therefore, that this invention is not limited to the particular embodiments disclosed, but is intended to cover all modifications which are within the scope and spirit of the invention as defined by the appended claims.

I claim:

1. An improved evaporator for cooling a fluid stream, the evaporator being adapted for use in a refrigeration system having evacuating means for withdrawing refrigerant vapor from the evaporator and condensing means for converting the refrigerant vapor to a high pressure refrigerant liquid flowing to the evaporator, said evaporator comprising first heat transfer means for receiving the high pressure refrigerant liquid from the condensing means and for exchanging heat between the high pressure refrigerant liquid and the fluid stream thereby cooling the high pressure refrigerant liquid and discharging it and warming the fluid stream and discharging it, pressure reducing means for receiving the cooled high pressure refrigerant liquid discharged by the first heat transfer means and for discharging it at reduced pressure, and second heat transfer means for receiving the warmed fluid stream discharged by the first heat transfer means and for receiving the reduced pressure refrigerant liquid discharged by the pressure reducing means and for exchanging heat between the warm fluid stream and the reduced pressure refrigerant liquid whereby the fluid stream is cooled and the reduced pressure refrigerant liquid stream is evaporated and the resulting vapor conveyed to the evacuating means.

2. Refrigeration evaporator means for receiving a fluid stream and cooling it and for receiving a high pressure refrigerant liquid, cooling and evaporating it, said evaporator means comprising a first heat exchange means for receiving and discharging the fluid stream and warming it and for receiving the high pressure refrigerant liquid and cooling it; pressure reducing means for receiving the cooled high pressure refrigerant liquid and reducing its pressure and discharging it; and second heat exchange means for receiving the fluid stream discharged by the first heat exchange means and cooling it and for receiving the reduced pressure refrigerant liquid discharged by the pressure reducing means and evaporating it.

3. Refrigeration evaporator means as recited in claim 2 where the first and second heat exchange means comprise a finned tube core having at least two operative tubing rows, said finned tube core having a first tube row for receiving the entering fluid stream and a last tube row for discharging the leaving fluid stream and further providing that at least a portion of the first tube row comprises the first heat exchange means for cooling the high pressure refrigerant and the last tube row comprises the second heat exchange means for cooling the fluid stream.

4. Refrigeration evaporator means as recited in claim 2 further including a shell adapted to receive the flow stream, and further providing that the second heat exchange means is positioned within the shell, whereby the passage of the flow stream through the shell causes it to be cooled by heat exchange with the second heat exchange means.

5. Refrigeration evaporator means as recited in claim 4 where the first heat exchange means is positioned within the shell.

6. Refrigeration evaporator means as recited in claim 4 where the first heat exchange means is positioned outside the shell.

7. Refrigeration evaporator means as recited in claim 6, further including means for diverting a portion of the fluid stream through the first heat exchanger means, the remainder of the fluid stream entering the second heat exchange means without traversing the first heat exchange means.

8. Refrigeration evaporator means as described in claim 4 where the diverting means includes pump means.

9. Refrigeration means as described in claim 2 where the first and second heat exchange means are mounted within a casing and the fluid stream comprises an airstream.

10. Refrigeration means as described in claim 2 where the first and second heat exchange means are mounted within a shell and the fluid stream comprises a liquid stream.

11. A refrigeration system for cooling an inlet fluid stream, the refrigeration system comprising; compressor means for compressing refrigerant vapor, condenser means for condensing the refrigerant vapor to a liquid, subcooler means for further cooling the liquid, expansion means for reducing the pressure of the liquid and evaporator means, all conduit connected seriatim, the evaporator means further including a fluid stream inlet and a fluid stream outlet, said evaporator means comprising an evaporator portion and further including said subcooler means operatively positioned with respect to the fluid stream inlet.

12. A refrigeration system as recited in claim 11 further including shell means for flow of the fluid stream therethrough, and further providing said evaporator means positioned within the shell means for establishing a heat transfer relation between the fluid stream and the evaporator means.

13. A refrigeration system as recited in claim 12 where the subcooling means is positioned within the shell.

14. A refrigeration system as recited in claim 12 the subcooling means is positioned outside the shell.

15. A refrigeration system as recited in claim 14 where the inlet fluid stream comprises a diverted and an undiverted portion and the subcooling means is subject to the diverted portion.

16. A refrigeration system as recited in claim 15, further including pump means for effectuating the diverted portion.

17. Means for receiving a fluid stream and cooling it, and for receiving a high pressure refrigerant liquid, cooling and evaporating it, said means comprising, a shell adapted to receive the fluid stream, a first heat exchange means for receiving and discharging the fluid stream and warming it and for receiving the high pressure refrigerant liquid and cooling it; pressure reducing means for receiving the cooled high pressure refrigerant liquid and reducing its pressure and discharging it; and second heat exchange means positioned within the shell for receiving the fluid stream discharged by the first heat exchange means and cooling it and for receiving the reduced pressure refrigerant liquid discharged by the pressure reducing means and evaporating it, whereby the passage of the fluid stream through the shell causes it to be cooled by heat exchange with the second heat exchange means.

18. Means as recited in claim 17 where the first heat exchange means is positioned within the shell.

19. Means as recited in claim 17 where the first heat exchange means is positioned outside the shell.

20. Means as recited in claim 19, further including means for diverting a portion of the fluid stream through the first heat exchange means, the remainder of the fluid stream entering the second heat exchange means without traversing the first heat exchange means.

21. Means as described in claim 20 where the diverting means includes pump means.

22. A refrigeration system for cooling an inlet fluid stream, the inlet fluid stream comprising a diverted and an undiverted portion, the refrigeration system comprising; shell means for flow of the fluid stream therethrough, compressor means for compressing refrigerant vapor, condenser means for condensing the refrigerant vapor to a liquid, subcooler means for further cooling the liquid, said subcooler means being positioned outside the shell means and subject to the diverted portion of the inlet fluid stream, expansion means for reducing the pressure of the liquid, and evaporator means positioned within the shell means for establishing a heat transfer relation between the fluid stream and the evaporator means, all of the compressor means, condenser means, subcooler means, expansion means and evaporator means being conduit connected seriatim, the shell means further including a fluid stream inlet for receiving the diverted and undiverted portions of the inlet fluid stream, and a fluid stream outlet.

23. A refrigeration system as recited in claim 22, further including pump means for effectuating the diverted portion of the inlet fluid stream.

* * * * *